United States Patent [19]

Gillotti

[11] 4,123,029

[45] Oct. 31, 1978

[54] BOOK HOLDER

[76] Inventor: Michael A. Gillotti, 11600 Barnett Valley Rd., Sebastopol, Calif. 95472

[21] Appl. No.: 791,990

[22] Filed: Apr. 28, 1977

[51] Int. Cl.[2] ..... A47B 97/04

[52] U.S. Cl. ..... 248/453

[58] Field of Search ..... 248/441 A, 441 R, 451, 248/452, 453, 460

[56] References Cited

U.S. PATENT DOCUMENTS

| | | | |
|---|---|---|---|
| 2,388,435 | 11/1945 | Puerner et al. | 248/441 A X |
| 3,408,032 | 10/1968 | Francis | 248/451 X |

*Primary Examiner*—William H. Schultz

[57] ABSTRACT

A stand for holding a book in an open, upright position on a horizontal surface, consisting of a face plate, held at a rearwardly inclined position by a rear mounted triangular support plate, and a book resting shelf located on the lower front side of face plate. The book is held in an open position by two page gripping assemblies at the book resting shelf level, including two page gripping brackets, connected to spring loaded rods, which grip the open book pages from below, holding the open pages against the face plate. The gripping assembly tension is adjusted by wing nuts at the ends of both rods.

4 Claims, 5 Drawing Figures

BOOK HOLDER

BACKGROUND OF THE INVENTION

This invention relates to a book holding device designed to hold a book in a readable position on a horizontal surface, thus freeing the reader's hands for other activities. This book holder is especially valuable to cooks and students, who need their hands free for cooking and note taking.

The greatest advantage of this particular book holder over others I've reviewed is its simplicity of design and function. It accomplishes with very few parts and mechanisms what more complex and costly book holders do. It holds in a rearwardly inclined, open position various sizes of hard and soft bound books, as well as magazines and other reading material.

Another advantage of this particular book holder is its weight and solid structure. Because the basic structure is formed from wood or other rigid material, a sturdy stand is provided and, thus, is less likely to be tipped over than is a wire or light metal frame book holder.

Finally, another advantage of this particular book holder is its aesthetic quality. Most other book holders are unattractive and, thus, are quickly stored after use. When made of wood, a variety of stains and finishes, as well as carved designs on its face are available. This invention can provide an artful addition to kitchen counter tops or other locations.

The objective of this invention is to provide an economical, easily operable and attractive book holder, which frees the reader's hands for other activities.

SUMMARY OF THE INVENTION

Generally, this book holder consists of a frame and book supporting structure and a pair of page gripping assemblies.

The frame and book supporting structure include a face plate held in a rearwardly inclined position by a triangular support plate mounted in the center, back side of the face plate in a vertically perpendicular position to the face plate. A book resting shelf extends from the lower front side of the face plate and in a horizontally perpendicular position to the face plate.

A pair of spring loaded page gripping devices are mounted at the level of the book resting shelf and hold the pages of the book in an open position against the face plate by gripping the lower edges of a book's open pages and pulling the pages firmly against the face plate. The gripping devices can be easily adjusted to various sizes of books and reading materials and are easily engaged and disengaged to allow pages to be turned.

DESCRIPTION OF THE INVENTION

Figure 1:
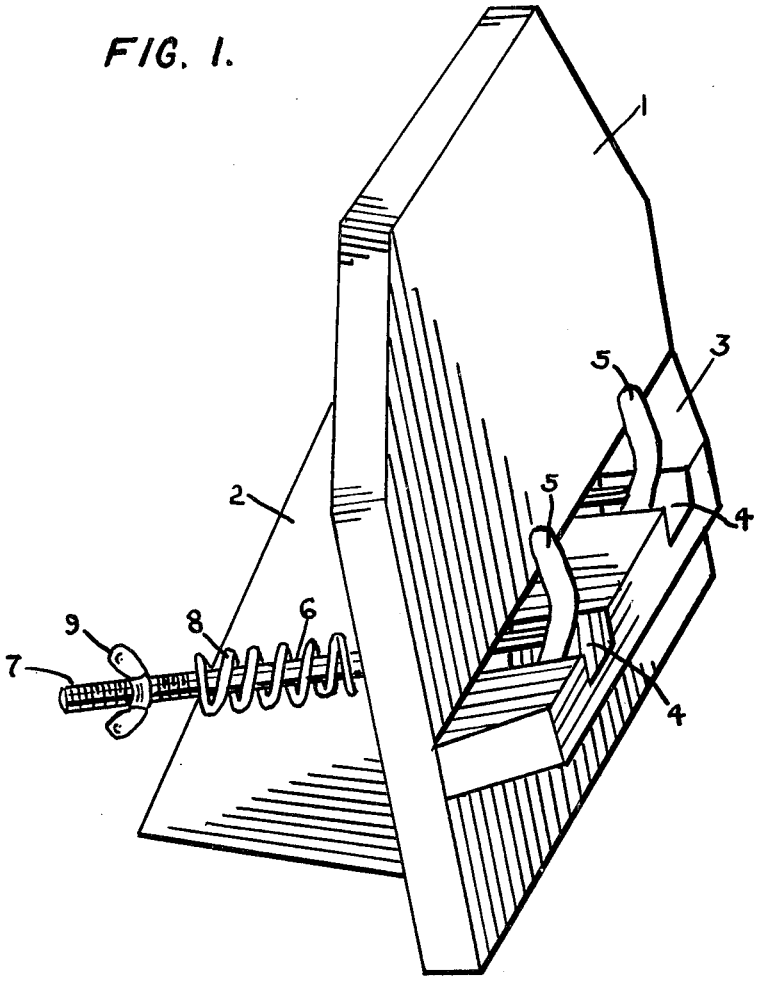
FIG. 1 is a front perspective view of the book holder.
Figure 2:
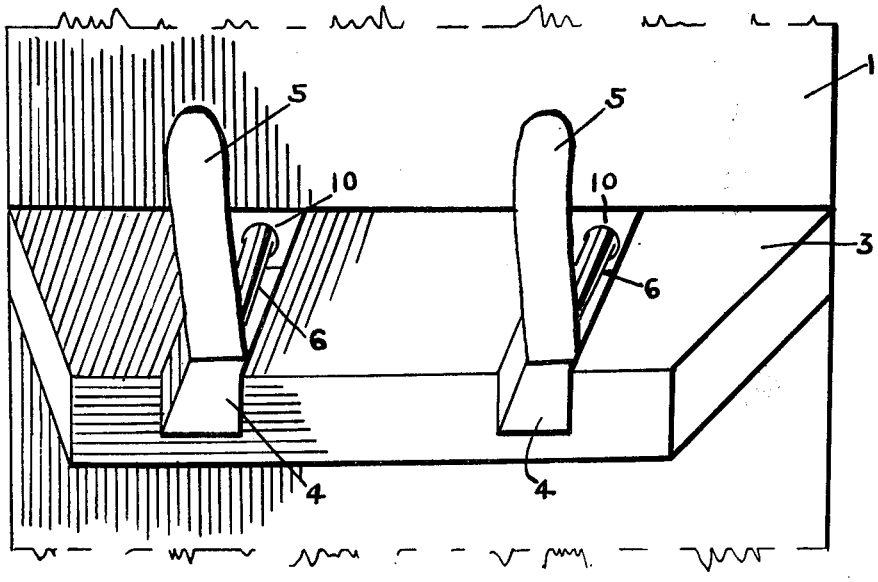
FIG. 2 is an enlarged, detail view of the book resting shelf, including the front section of the page gripping assemblies.
Figure 3:
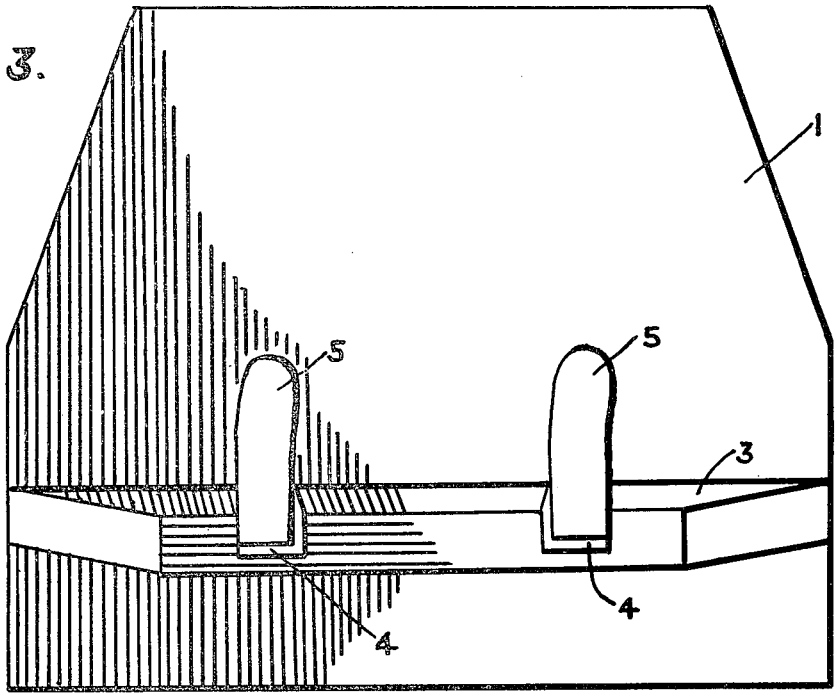
FIG. 3 is a front view.
Figure 4:
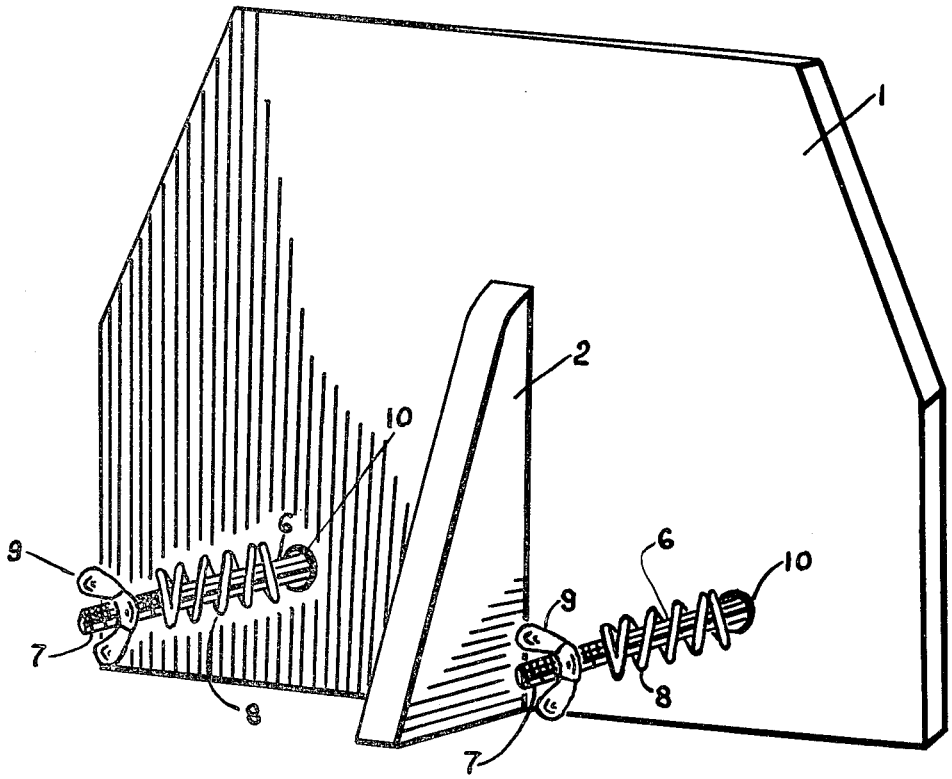
FIG. 4 is a back perspective view.
Figure 5:
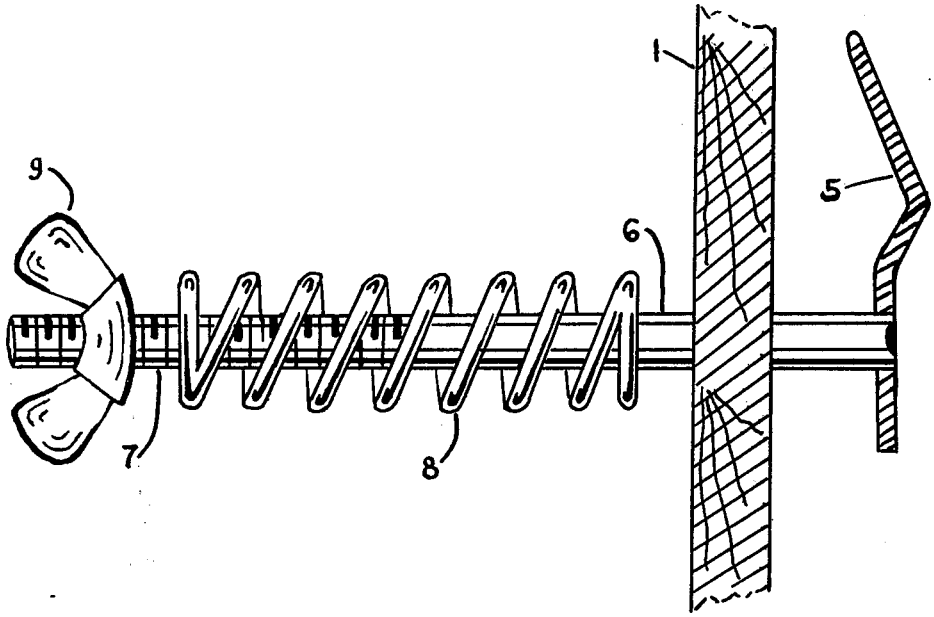
FIG. 5 is an enlarged detail view of one page gripping assembly.

The book holder of this invention includes a face plate 1, a triangular support plate 2, and a book resting shelf 3, all of which, although indicated as formed from wood, may be formed of plastic, metal or other rigid material. The face plate 1 is held in a rearwardly inclined position by the triangular support plate 2, mounted in the center, back side of the face plate 1, and in a vertically perpendicular position to the face plate 1. The triangular support plate 2 is attached to the face plate 1 by nails, screws and glue, though it may be attached by any one or a combination of these materials or may be welded or formed together in a mold if desired. The book resting shelf 3 is mounted on the lower, front side of the face plate 1 and in a horizontally perpendicular position to face plate 1. The book resting shelf 3 is attached to face plate 1 in the same manner as is the triangular support plate 2.

At equal distances from the vertical edges of the face plate 1 two guide notches 4 are provided in the book resting shelf 3, which guide a pair of page gripping brackets 5 as they move toward and away from the face plate 1 to engage and disengage the leaves of a book. This page gripping mechanism will be described more fully. Also at equal distances from the vertical edges of the face plate 1, and at the level of the guide notches 4, two circular openings 10 are provided, which extend from the front to the back side of the face plate 1, and through which pass a pair of rods 6.

The page gripping assemblies include a pair of each of the following: page gripping brackets 5, rods 6, the ends of which rods are threaded 7, coil springs 8, and wing nuts 9. Though indicated as formed from metal, all parts of the page gripping assemblies may be formed of wood, plastic, or other suitable material. Though the rods 6 are shown perpendicularly attached to the gripping brackets 5 by welding, they may be attached by nails, screws glue or a combination these materials or may be formed together in a mold. The rods 6 pass through the openings 10 and through coil springs 8. Threads 7 are provided on at least the last one-third section of rods 6, and onto these threads 7 wing nuts 9 or similar type nuts are attached. Thus the compression of the coil springs 8 may be increased or decreased by tightening and loosening the wing nuts 9, and the lengths of the rods 6 remaining on the front side of the face plate 1 may be increased or decreased by loosening or tightening the wing nuts 9.

The coil springs 8 are of a larger diameter than are the openings 10, so that they must remain on the back side of the face plate 1. As the coil springs 8 release their compressions, they must move away from the back surface of the face plate 1, and as the coil springs 8 push against the wing nuts 9, the entire page gripping assemblies are moved rearwardly. Thus, as the coil springs 8 release their compressions, the page gripping brackets 5 are pulled along their guide notches 4 and toward the front surface of the face plate 1, trapping the leaves of a book between the page gripping brackets 5 and the front surface of the face plate 1.

A book is supported in an open, upright position by placing the lower edges of the book upon the book resting shelf 3, so that the book's binding rests in a rearwardly inclined position against the front surface of the face plate 1. The book is maintained in open position by a pair of page gripping brackets 5, which firmly press the lower edges of a book's leaves against the front surface of the face plate 1. Larger books are accommodated by loosening wing nuts 9, and thus, decreasing the coil springs' 8 compressions, and smaller books are accommodated by tightening the wing nuts 9, and thus, increasing the coil springs' 8 compressions.

When a page is to be turned, the right sided page gripping bracket 5 is disengaged from the book's leaves by pulling it away from the front surface of the face plate 1. The page is then manually grasped and moved toward the left, while the right page gripping bracket 5 is released against the next page. The left page gripping bracket is then disengaged, the page which is being turned is moved to the left toward the face plate 1, and left page gripping bracket 5 is released against it. Since each page gripping assembly is independent of the other, it is possible to adjust the tension of each assembly independently as may be desired as one progresses through a book.

The foregoing is considered as illustrative only of the principles of the invention, and though described as a book holder, is also suitable to hold magazines and other reading materials. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed is:

1. A book holder for supporting a book in open reading position on a horizontal surface comprising a frame and book support structure, including a face plate held in a rearwardly inclined position by a triangular support plate mounted on the center back side of said face plate and vertically perpendicular to said face plate; a book resting shelf mounted on the lower front side of said face plate and horizontally perpendicular to said face plate, a book being supported in a rearwardly inclined position against said face plate, the lower edges of a book being supported by said book resting shelf;

a pair of page gripping assemblies, including a pair of page gripping brackets attached to a pair of rods, said rods mounted through a pair of openings in the face plate, a pair of coil springs coaxial with said rods on the back side of said face plate, the ends of said rods being threaded, adjusting nuts being fitted onto the rod ends; said page gripping assemblies being located at equal distances from the vertical edges of the face plate and at the level of the book resting shelf, and said page gripping brackets guided toward and away from the face plate by two guide channels in the book resting shelf each channel being aligned with a respective opening and means on each page gripping assembly for engaging a respective channel, the pages of a book being trapped and held in open position between the page gripping brackets and the face plate.

2. A book holder for supporting a book in open reading position on a horizontal surface comprising a frame and book support structure, including a face plate held in a rearwardly inclined position by a triangular support plate mounted on the center back side of said face plate and vertically perpendicular to said face plate; a book resting shelf mounted on the lower front side of said face plate and horizontally perpendicular to said face plate, a book being supported in a rearwardly inclined position against said face plate, the lower edges of a book being supported by said book resting shelf;

a pair of page gripping assemblies each page gripping assembly comprising a rod extending through an opening in the face plate, said shelf comprising a guide channel aligned with each opening and said page gripping assembly comprising means engaging said guide channel, said channels being placed at equal distances from the vertical edges of said face plate, said page gripping assemblies being moved by the rearwardly exerted force of coil springs coaxial with rods for releasable engagement of the pages of a book between page gripping assemblies mounted at said rod ends and the said face plate, the compressions of said coil springs being independently adjustable by adjusting nuts at threaded rod ends according to the number of pages of the book engaged and the coil spring compression level desired.

3. A book holder for holding a book in an open, upright position comprised of a face plate in a rearwardly inclined position by a support plate mounted in the center, back side of said face plate and vertically perpendicular to said face plate, a book resting shelf mounted on the lower front side of said face plate and horizontally perpendicular to said face plate, a pair of spring loaded, page gripping assemblies mounted at the level of the book resting shelf for releasable engagement of the lower edges of a book's leaves each page gripping assembly comprising a rod extending through an opening in the face plate, said shelf comprising a guide channel aligned with each opening and said page gripping assembly comprising means engaging said guide channel, the weight of the book being supported by the book resting shelf.

4. A book holder for holding a book in an open, upright position comprised of a face plate held in a rearwardly inclined position by a support plate mounted on the back side of said face plate, a book resting shelf mounted on the front side of said face plate and horizontally perpendicular to said face plate, a pair of spring biased, page gripping assemblies mounted at the level of the book resting shelf for releasable engagement of the lower edges of a book's leaves, each page gripping assembly comprising a rod extending through an opening in the face plate, said shelf comprising a guide channel aligned with each opening and said page gripping assembly comprising means engaging said guide channel, the weight of the book being supported by the book resting shelf.

* * * * *